US006860757B2

(12) United States Patent
Herrnring et al.

(10) Patent No.: US 6,860,757 B2
(45) Date of Patent: Mar. 1, 2005

(54) CONNECTION SYSTEM FOR CONNECTING WEIGHING CELLS

(75) Inventors: Joerg Herrnring, Hamburg (DE); Wolf Dieter Schulze, Bad Oldesloe (DE); Eugen Gassmann, Grosshansdorf (DE); Matthias Mueller, Lage (DE); Arian Frikkee, Detmold (DE)

(73) Assignee: GWT Global Weighing Technologies GmbH, Hamburg (DE)

( * ) Notice: Subject to any disclaimer, the term of this patent is extended or adjusted under 35 U.S.C. 154(b) by 118 days.

(21) Appl. No.: 10/106,683

(22) Filed: Mar. 22, 2002

(65) Prior Publication Data

US 2002/0146934 A1 Oct. 10, 2002

(30) Foreign Application Priority Data

Mar. 23, 2001 (DE) ..... 101 14 669
Oct. 12, 2001 (DE) ..... 101 50 641

(51) Int. Cl.[7] ..... H01R 13/60
(52) U.S. Cl. ..... 439/535; 439/490; 439/736; 439/209
(58) Field of Search ..... 439/535, 490, 439/736, 209, 521, 949, 894

(56) References Cited

U.S. PATENT DOCUMENTS 4,586,575 A 5/1986 Muerdter et al.
4,659,161 A * 4/1987 Holcomb ..... 439/490
6,527,599 B2 * 3/2003 Bechtold et al. ..... 439/736

FOREIGN PATENT DOCUMENTS

DE 297 06 450 U 1 9/1998
DE 200 14 849 U 1 11/2000
EP 1 039 589 A1 3/2000

* cited by examiner

*Primary Examiner*—Truc Nguyen
(74) *Attorney, Agent, or Firm*—Nixon Peabody LLP; David S. Safran

(57) ABSTRACT

The present invention is related to a connection system for connecting weighing cells to a connection cable, wherein the connection system has a housing with at least one plug-in connector for connecting a connection cable and at least one further plug-in connector for connecting at least one weighing cell. A method for operational monitoring of weighing cells is also provided. Using the connection system according to the present invention significantly simplifies the installation of one or more weighing cells and simultaneously minimizes the susceptibility to error. The object of monitoring the operation and the installation of weighing cells is achieved in that at least the states voltage supply, loop current, polarity reversal, and cable break are indicated.

11 Claims, 2 Drawing Sheets

CONNECTION SYSTEM FOR CONNECTING WEIGHING CELLS

BACKGROUND OF THE INVENTION

The present invention relates to a connection system for connecting weighing cells to a connection cable.

To measure the load of a receptacle, for example a silo, weighing cells are used. If multiple weighing cells are used, singly or connected in parallel, then as a rule they must be electrically connected with a central data acquisition system. Until now, this wiring was implemented with the aid of screw clip terminals. In this case, the individual flexible cords, for example for the supply voltage, the signal voltage, and the shielding, each had to be attached individually to an associated screw clip terminal.

In the previously known connection system for multiple weighing cells, the installation, particularly in the event of cabling a large number of weighing cells, was very complex and subject to errors. The replacement of individual weighing cells also involved the danger of a cabling error. It is further disadvantageous in the known connection system for weighing cells that no error detection exists which differentiates the different error states, for example a cable break and polarity reversal.

BRIEF SUMMARY OF THE INVENTION

Proceeding from the related art described, the object of the present invention is to provide a connection system for connecting weighing cells to a connection cable which significantly simplifies the installation of one or more weighing cells and simultaneously minimizes the susceptibility to errors of the installation.

DETAILED DESCRIPTION OF THE INVENTION

Figure 1:
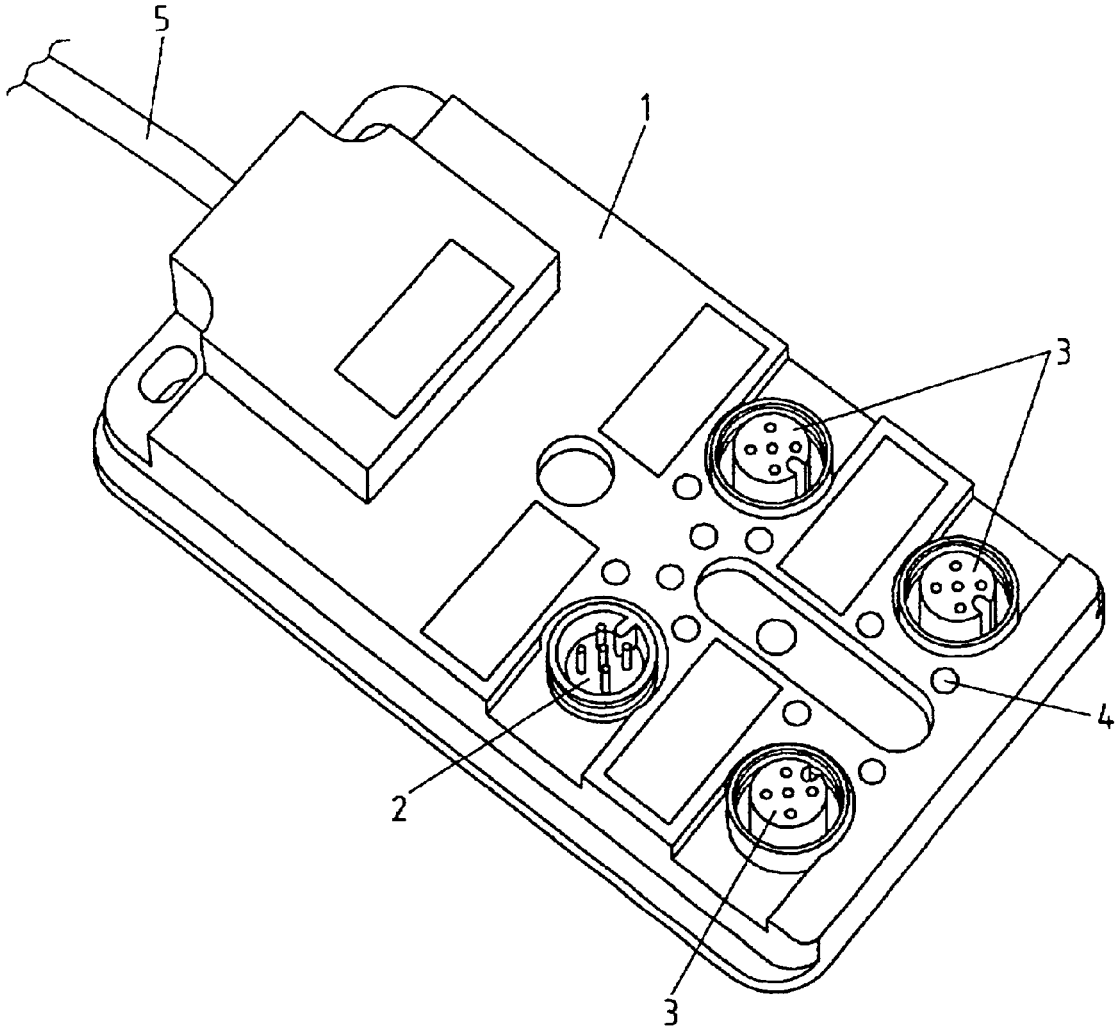
FIG. 1 is a first exemplary embodiment of a connection system according to the present invention for connecting a connection cable and one single weighing cell or two weighing cells operated in parallel.

According to the present invention, the previously introduced and described object is achieved for a connection system for connecting weighing cells to a connection cable in that at least one plug-in connector for connecting a connection cable and at least one further plug-in connector for connecting at least one weighing cell is provided in the housing of a connection system. The plug-in connectors are used in this case as removable electrical contacts and, according to the present invention, significantly ease the installation of a connection system for connecting weighing cells to a connection cable.

If multiple plug-in connectors for connecting multiple weighing cells are provided, then, according to a further embodiment of the connection system according to the present invention, the parallel operation of multiple weighing cells on one connection cable is possible without complicated installation.

Another embodiment of the connection system according to the present invention is advantageously embodied in that differently coded plug-in connectors are provided for the connection cable and the weighing cells. Confusion of the plug positions of the plug-in connectors for the connection cable and the weighing cells is no longer possible due to the coding. The susceptibility to error of the installation of the connection system is further reduced in this way.

The susceptibility to error of the installation is also reduced further if, according to a further embodiment of the connection system according to the present invention, a male plug is provided for the connection cable and a female plug is provided for each of the weighing cells. Therefore, plug-in connectors for the connection cable and for the weighing cells can be differentiated solely by the type of the plug-in connector in the connection system.

Therefore, because an automatic differentiation between the operation of one or more weighing cells is provided via the respective plug-in connectors selected, according to another advantageous embodiment, the programming of internal amplifiers may be performed according to the assignment of the plug-in connectors. Later programming of an internal amplifier for amplifying the measurement signals of the weighing cells is therefore no longer necessary.

The avoidance of cabling errors for the different modes of operation of the connection system, for example the operation of one weighing cell or of multiple weighing cells in parallel, is achieved according to a refined embodiment in that the different plug-in connectors of the weighing cells are differently coded for the operation of one or more weighing cells. For example, the coding for two weighing cells operated in parallel may be ensured, for example, by an identical installation angle of a plug-in connector, which is provided with a rotating protection element, relative to an axis, such as the longitudinal axis of the housing of the connection system.

A connection system according to the present invention is particularly advantageously embodied if means for detecting and automatically indicating various operating states of the connection system are provided. Automatic indication of the various operating states of the connection system ensures a particularly simple error search.

Therefore, according to a refined embodiment, if at least one light emitting diode is provided for automatically indicating the operating states, a particularly cost-effective and reliable indication of the operating states of the connection system may be ensured.

According to a refined embodiment, at least the operating states voltage supply, loop current, polarity reversal, and cable break are displayable. According to the present invention, the essential possible errors of a connection system for weighing cells are thus indicated, so that error analysis may be performed very rapidly.

If, in another embodiment, at least one grounding cable and possibly a gas surge arrester are provided, the weighing cells connected to the connection system may be protected from surges from the main connection.

In order to ensure the use of the connection system according to the present invention even in the event of high requirements for protection, for example the type of protection IP 67/68, according to a refined embodiment of the connection system according to the present invention, cavities in the housing of the connection system and in the plug-in connectors are filled with a plastic. In this way, for example, protection against the penetration of dust and water in the event of submersion in accordance with IP type of protection IP68 may be ensured.

If, according to a method according to the present invention for operational monitoring of weighing cells, at least the states voltage supply, loop current, polarity reversal, or cable break of the respective weighing cell connected are indicated, the essential possible errors occurring during operation and installation of the weighing cells may be determined directly. The operational reliability of weighing cells may therefore be significantly increased and errors may be corrected with the method according to the present invention.

There are multiple possibilities for implementing and refining the connection system for weighing cells according to the present invention and/or the method for operational monitoring of weighing cells according to the present invention. For this purpose, reference is made to the following:

An embodiment of the invention includes a connection system for the connection of weighing cells to a connection cable, having a housing, with at least one plug-in connector for connecting a connection cable and at least one further plug-in connector for connecting at least one weighing cell being provided in the housing. The connection system may include multiple plug-in connectors for connecting multiple weighing cells. Differently coded plug-in connectors may be provided for the connection cable and the weighing cells. A male plug may be provided for the connection cable and a female plug may be provided for each of the weighing cells. The connection system may provide automatic differentiation between the operation of one or more weighing cells via the respective plug-in connector selected. The different plug-in connectors of the weighing cells may be differently coded for the operation of one or more weighing cells. The connection system may include means for detecting and automatically indicating different operating states of the connection system. The connection system may include at least one light emitting diode for automatically indicating the operating states. At least the operating states voltage supply, loop current, polarity reversal, and cable break may be displayable. The connection system may include at least one grounding cable and possibly a gas surge arrester. Cavities in the housing of the connection system and in the plug-in connector may be filled with a plastic.

An embodiment of the invention includes a method for operational monitoring of weighing cells, particularly to be implemented with the aid of the aforementioned connection system features, in which at least the states voltage supply, loop current, polarity reversal, and cable break of the respective weighing cells connected are indicated.

Reference is also made to the description of preferred exemplary embodiments in connection with the FIGS.

In FIG. 1, an exemplary embodiment according to the present invention of a connection system for weighing cells is illustrated which has a housing 1, a plug-in connector 2 for the connection cable, and plug-in connectors 3 for connecting one or more weighing cells. In addition, in housing 1 of the connection system according to the present invention, light emitting diodes 4 and a grounding cable 5 are provided. In this case, light emitting diodes 4 are used to indicate operating states, for example voltage supply, loop current, polarity reversal, and cable break of the connected weighing cells. With the aid of grounding cable 5, the entire connection system may be connected to a fixed potential, and, for example, may also be grounded.

As is obvious from FIG. 1, plug-in connector 2 of the connection cable is implemented as a male plug and plug-in connectors 3 for the weighing cells are implemented as female plugs. Therefore, it is not possible for plug-in connectors 2 and 3 to be confused during connection of the weighing cells or the connection cable. In addition, plug-in connectors 3 for connecting the weighing cells are coded differently from one another, so that it is simple to differentiate between the connection of one single weighing cell and two weighing cells connected in parallel. Light emitting diodes 4 are arranged in this case so that they display the operating state of the respective associated plug-in connector.

Figure 2:
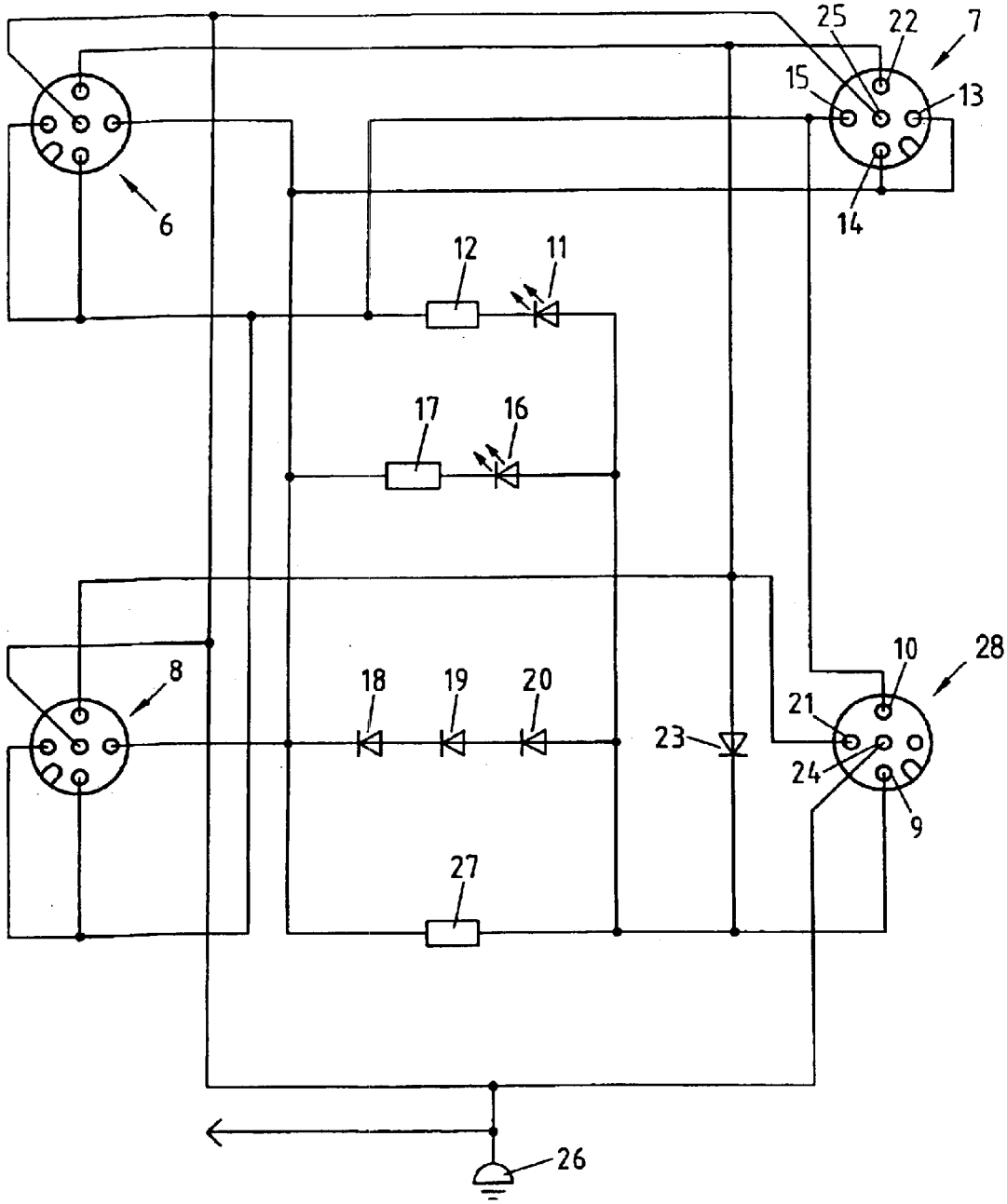
FIG. 2 is an exemplary embodiment of an electrical circuit which ensures the method according to the present invention for operational monitoring of weighing cells.

The electrical circuit diagram of a circuit of a second exemplary embodiment which allows the method according to the present invention for operational monitoring of weighing cells is illustrated in FIG. 2. In this case, plug-in connector 28 is provided for connecting the connection cable to supply the weighing cells and sockets 6, 7, and 8 are each provided for the connection of weighing cells. The weighing cells connected to sockets 6 to 8 are supplied with voltage via electrical contacts 9 and 10 of plug-in connector 28. In the following, the mode of operation of this circuit is described using the example of the connection of one weighing cell to the connection system. If only one weighing cell is connected to socket 7 provided for this purpose, a current, which flows through light emitting diode (LED) 11 via resistor 12, signals whether the correct supply voltage is applied between electrical contacts 13 or 14 and 15 of socket 7 of the single connection. If the cable conducting the voltage is interrupted at any location, then LED 11, which is not activated, signals that the correct supply voltage has not been applied. The loop current between electrical contacts 13 or 14 and 15 of socket 7 of the single connection is displayed by LED 16 if it is appropriately activated via resistor 17. In the case of proper connection and operation of the individual weighing cell, there is a sufficiently large voltage drop via the voltage divider, which is formed from diodes 18 to 20 and resistor 27, so that a sufficiently large current activates LED 16.

As soon as this loop current is interrupted, i.e. there is a cable break in the region of the voltage supply of the weighing cells, this is signaled by switched-off LED 16. Furthermore, plug contact 21 of plug-in connector 28 of the connection cable is also connected with the signal line via plug contact 22 of connection socket 7 of the weighing cell. In order to keep the signal line for the weighing signal free of surges caused by the main connection, a gas surge arrester 23 may be connected between plug contact 21 of plug-in connector 28 and contact 9 of plug-in connector 28. Furthermore, the entire system, i.e. plug-in connector 28 of the connection cable and connection socket 7 of the weighing cells, is grounded via electrical contacts 24, 25 of the respective plug-in connection via grounding system 26.

What is claimed is:

1. A connection system for connecting weighing cells to a connection cable comprising:

a housing with at least one plug-in connector for connecting the connection cable; and at least one further plug-in connector for connecting at least one weighing cell being provided in the housing;

wherein means for detecting and automatically indicating a plurality of different operating states of the connection system are provided.

2. The connection system according to claim 1, wherein multiple plug-in connectors are provided for connecting multiple weighing cells.

3. The connection system according to claim 2, wherein automatic differentiation between the operation of one or more weighing cells is provided via the respective plug-in connector selected.

4. The connection system according to claim 2, wherein the different plug-in connectors of the weighing cells are differently coded for the operation of one or more weighing cells.

5. The connection system according to claim 1, wherein differently coded plug-in connectors are provided for the connection cable and the weighing cells.

6. The connection system according to claim 1, wherein a male plug is provided for the connection cable and a female plug is provided for each of the weighing cells.

7. The connection system according to claim 1, wherein at least the operating states voltage supply, loop current, polarity reversal, and a cable break of the respective weighing cells connected are displayable by said means for detecting and automatically indicating.

8. The connection system according to claim 1, wherein at least one light emitting diode for automatically indicating the operating states is provided.

9. The connection system according to claim 1, wherein at least one grounding cable and, optionally, a gas surge arrester is provided.

10. The connection system according to claim 1, wherein cavities in the housing of the connection system and in the plug-in connectors are filled with a plastic.

11. A method for operational monitoring of weighing cells utilizing a connection system for connecting weighing cells to a connection cable comprising a housing with at least one plug-in connector for connecting the connection cable and at least one further plug-in connector for connecting at least one weighing cell being provided in the housing; wherein the connections system indicates the states of at least the voltage supply, loop current, polarity reversal, and a cable break of the respective weighing cells connected.

* * * * *